United States Patent [19]

LeRoy

[11] 4,156,295

[45] May 29, 1979

[54] REVISED POCKET

[76] Inventor: Edward W. LeRoy, 45-25 Kennedy Blvd., North Bergen, N.J. 07047

[21] Appl. No.: 663,559

[22] Filed: Mar. 3, 1976

Related U.S. Application Data

[63] Continuation-in-part of Ser. No. 551,162, Feb. 19, 1975, abandoned.

[51] Int. Cl.[2] ..... A41D 27/20

[52] U.S. Cl. ..... 2/252

[58] Field of Search ..... 2/247, 253, 252, 251, 2/254, 94

[56] References Cited

U.S. PATENT DOCUMENTS

| | | | |
|---|---|---|---|
| 1,763,688 | 6/1930 | Champion | 2/247 |
| 2,038,331 | 4/1936 | Woolf | 2/253 |
| 2,211,420 | 8/1940 | Hausdorff | 2/247 |
| 2,260,427 | 10/1941 | Bailey | 2/94 |
| 2,383,746 | 8/1945 | Shapiro | 2/247 |
| 2,607,040 | 8/1952 | Zaleski | 2/252 X |
| 2,840,825 | 7/1958 | Garrido | 2/252 |
| 2,883,673 | 4/1959 | Solomon | 2/253 |

*Primary Examiner*—Werner H. Schroeder

[57] ABSTRACT

An elongated pocket having a flat bottom edge and a flaring top is reinforced with a back up piece of fabric and is closed by a zipper attached to the upper inner edge of the front panel and to the face of the garment, a flap attached above the zipper covers the zipper and increases the ornamentation of the pocket and gives it strengthening support.

3 Claims, 5 Drawing Figures

REVISED POCKET

This is a continuation-in-part application of the copending application Ser. No. 551,162 filed on Feb. 19, 1975, now abandoned.

I have invented a new and novel revised pocket. My pocket is sealed with a zipper for holding an object such as a pocket calculator, a cigarette pack, a pair of glasses or other essential valuables. The zipper is attached to the upper inside edge of the pocket and to the outside of the garment adjacent to the upper edge of the pocket. The attachment of the flap to the garment is just above the zipper and at the top, so that the flap may lie over the zipper. Any item inserted into the pocket is held in place in the pocket by the closure of the zipper which is attached to the upper inside end of the pocket. Furthermore, a backup piece of fabric attached to the rear surface of the garment behind the attachment of the pocket provides additional strength and protection for the contents of the pocket. Still, further, the bottom edge of the pocket is squared off and the pocket is narrower and longer than the conventional pocket so that objects are comfortably secured therein without extending out beyond the pocket.

My invention can be understood in view of the accompanying figures.

Figure 1:
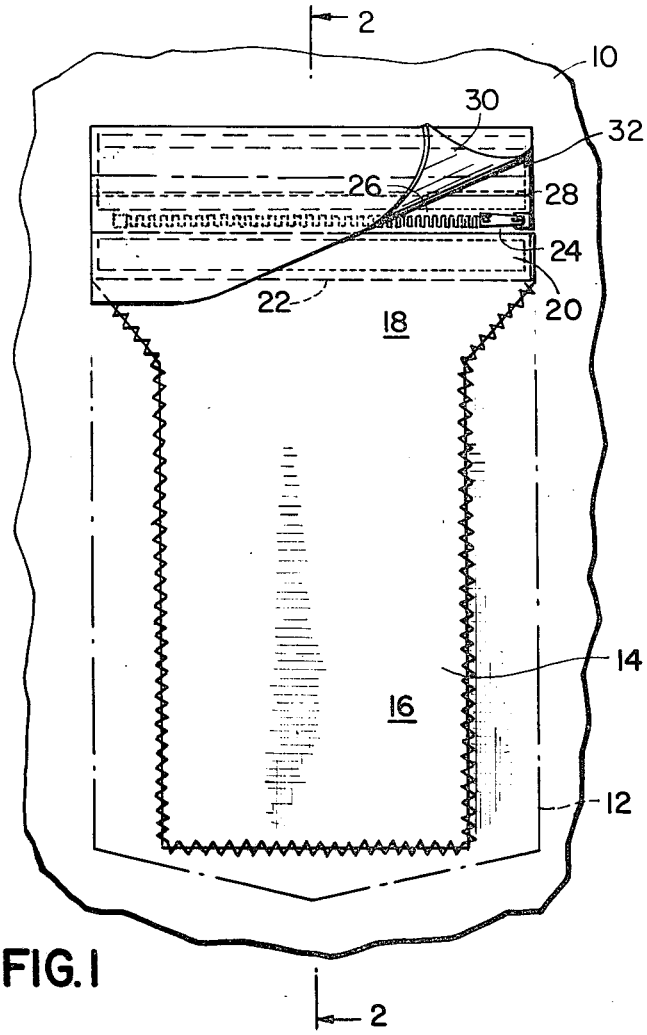
FIG. 1 is a front view of the revised pocket with a standard pocket shown in phantom across the revised pocket and showing the zipper design.
Figure 2:
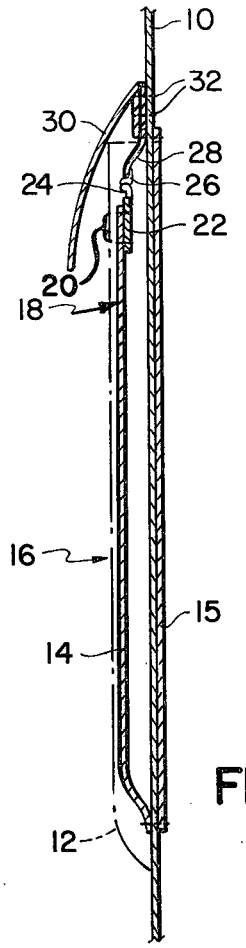
FIG. 2 is a section of FIG. 1 taken in the plane 2—2.
Figure 5:
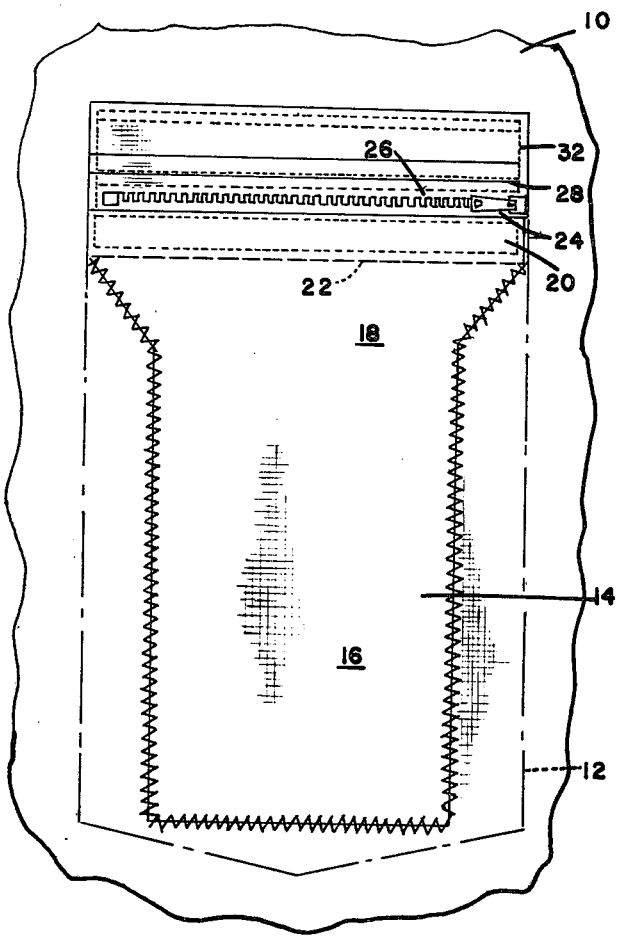
FIG. 5 shows the pocket of FIG. 1 with the flap removed.

With regard to FIGS. 1, 2, and 5 on a shirt fabric or other suitable garment material 10 a standard pocket can be seen to be attached in phantom 12. The pocket is formed by a front panel 14 attached to the front of the shirt goods 10 and a rear reinforcing panel 15 attached behind the shirt goods 10 to the shirt goods 10. The lower portion 16 of the revised pocket is of rectangular shape with a flat bottom, the next upper section of the pocket has edges that slopingly flare outwardly to join a wide section 20 where the mounting strip 22 of a lower section of a zipper 24 is sewn to the inside surface of the front panel of the pocket 14. The upper section of the zipper 26 has a mounting strip 28 sewn to the front of the shirt goods 10 and to the rear reinforcing fabric 15 which extends to the top of the flap. A flap 30 is sewn 32 to the shirt goods 10 and to the upper part of the zipper mounting strip 28, and just above the zipper.

Figure 3:
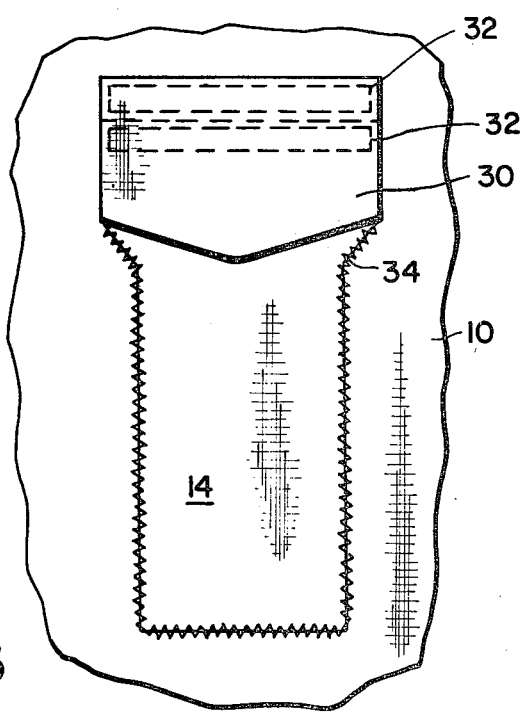
FIG. 3 is a superficial front view of a modification of the revised pocket having embellishments along the edge of the pocket seam.

With regard to FIG. 3, on the shirt goods 10 the front panel 14 can be seen and the front of the flap 30 is sewn 32, to the upper mounting strip over the garment and above the zipper with the decorative zig zag ornamentation 34 visible along the edge of the revised pocket, 14.

Figure 4:
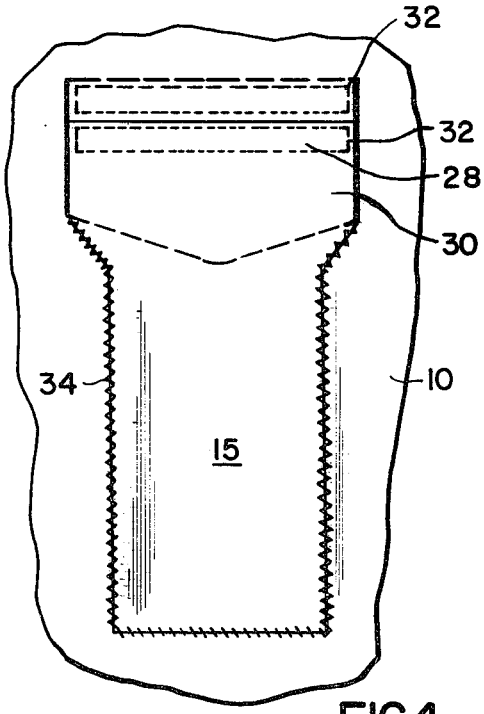
FIG. 4 is a superficial view of the rear of the revised pocket with the embellishments of the embodiment of FIG. 3.

With regard to FIG. 4, on the shirt goods 10, the reinforcing rear panel 15 can be seen along with the stitching 32 for attaching the upper zipper attaching strip 28 of FIGS. 1 and 2. In addition the stitching 32 for attaching the flap 30 and the upper zipper mounting strip 28 of FIGS. 1, 2 and 3 is visible. The decorative zig zag stitching 34 is visible through the rear surface of the revised pocket.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A revised pocket, comprising:

a fabric of a garment, a backing panel attached to a rear surface of the fabric, a front panel attached to the fabric overlying the backing fabric, a lower attaching strip of a lower section of a zipper attached to an inner surface of an upper end of the front panel of the revised pocket, an upper attaching strip attached to an upper portion of the zipper and attached to the garment fabric and the reinforcing rear panel, a flap attached to the fabric and upper attaching strip of the upper part of the zipper, the front panel and the reinforcing rear panel each form a lower elongated section of rectangular shape having a flat bottom edge and enlargingly tapering upwardly at an upper end of the lower section to form a wide rectangular uppermost section, and the zipper attached to the uppermost rectangular section of the front panel.

2. The revised pocket of claim 1, wherein a decorative zig-zag is added to a seam of the pocket.

3. The revised pocket of claim 2, wherein the seam is the edge of the pocket.

* * * * *